United States Patent [19]

Dale

[11] 4,406,631

[45] Sep. 27, 1983

[54] FLOTATION DEVICE

[75] Inventor: John R. Dale, Pennsburg, Pa.

[73] Assignee: The United States of America as represented by the Secretary of the Navy, Washington, D.C.

[21] Appl. No.: 308,309

[22] Filed: Oct. 5, 1981

[51] Int. Cl.[3] ..... B63B 21/52

[52] U.S. Cl. ..... 441/30; 244/138 R; 343/709; 441/33

[58] Field of Search ..... 441/1, 6, 7, 11, 30, 441/31, 33, 90; 367/3, 4; 343/709, 710, DIG. 2; 244/138 R, 139

[56] References Cited

U.S. PATENT DOCUMENTS

| | | | |
|---|---|---|---|
| 3,059,253 | 10/1962 | Sager | 441/80 |
| 3,081,466 | 3/1963 | Bailey | 367/4 X |
| 3,093,808 | 6/1963 | Tatnall et al. | 367/4 |
| 3,098,229 | 7/1963 | Raabe | 343/DIG. 2 |
| 3,150,387 | 9/1964 | Look et al. | 441/30 |
| 3,278,956 | 10/1966 | Maes | 367/4 X |
| 3,382,514 | 5/1968 | Boscov | 441/30 X |
| 3,474,474 | 10/1969 | Busenkell et al. | 441/136 |
| 3,488,783 | 1/1970 | Lockwood, Jr. | 441/11 |
| 4,186,370 | 1/1980 | Cupolo et al. | 441/11 |

*Primary Examiner*—Sherman Basinger

*Attorney, Agent, or Firm*—Robert F. Beers; Henry Hansen

[57] ABSTRACT

An air launchable sonobuoy having two separate liquid chemicals which react upon mixing to form an expanded, rigid foam flotation device. Upon deployment in the air, windflaps release a preloaded plate within a submersible housing and urge the chemicals to mix and foam in an elastic envelope. After water impact, an orifice in the housing permits water to fill the voids at a rate sufficient to allow the housing to remain afloat until foaming and erection of an antenna within the envelope is complete. As the envelope expands, a latch releases it from the housing and permits the housing when flooded to sink to the desired depth determined by the payout length of a cable within the housing connected to the flotation device.

13 Claims, 13 Drawing Figures

FLOTATION DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates in general to buoys, and in particular, to an automatically deployable flotation device for air-dropped sonobuoys.

A typical air-launched sonobuoy of the prior art deploys a gas bag which is automatically inflated upon contact with the water to provide the flotation required to support the sonar receiving and transmitting equipment. The bag usually has an opening attached with O-ring seals around a machined surface of a housing containing the pressurized gas cartridge used for inflation. Too frequently, there is leakage due to foreign matter at the seals, O-ring faults, or poorly machined surfaces. Occasionally, the gas cartridges fail or seams in the bag leak gas. Any of these occurrences shorten the useful life of the sonobuoy.

SUMMARY OF THE INVENTION

Accordingly, it is a general purpose and object of the invention to provide a flotation device for a buoy which is more reliable and thereby ensures full operation of the buoy for its designed life. Another object is to provide a flotation device which can be stored in a relatively small space within the buoy, and which can be expanded into a low density material impervious to water and into a sufficient volume for maintaining the buoy at the surface of the water. Still another object is to provide an automatically deployable flotation device which is particularly suitable for use in an air-launched sonobuoy. A further object of the invention is to provide a flotation device which is of relatively simple design, and inexpensive to manufacture and operate.

Briefly, these and other objects of the invention are accomplished by a novel arrangement of two separate liquid chemicals stored within an air launchable buoy which react upon mixing to form an expanded, rigid foam flotation device. Immediately after deployment of the buoy in the air stream, windflaps release a preloaded plate within a submersible housing urging the chemicals to mix and react in an elastic envelope. After water impact, an orifice in the housing permits water to fill the voids at a rate sufficient to allow the housing to remain afloat until foaming and erection of an antenna within the envelope is completed. As the envelope expands, a latch releases it from the housing and permits the housing when flooded to sink to the desired depth determined by the payout length of a cable within the housing connected to the flotation device.

The foregoing and other objects and antendant advantages of the present invention will be readily appreciated as the same become better understood by reference to the following detailed description when considered by the accompanying drawings, wherein:

DESCRIPTION OF THE PREFERRED EMBODIMENT

Figure 1:
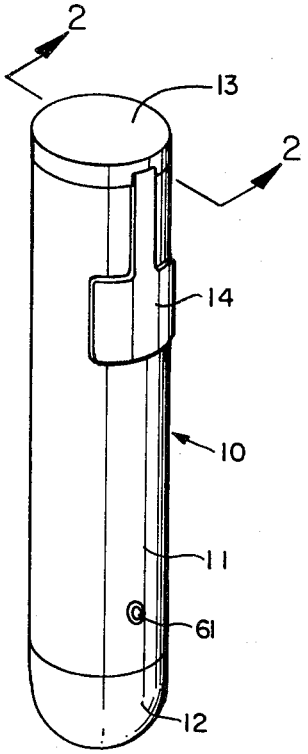
FIG. 1 represents an overall view of an air-dropped sonobuoy according to the invention in a prelaunch configuration.
Figure 2:
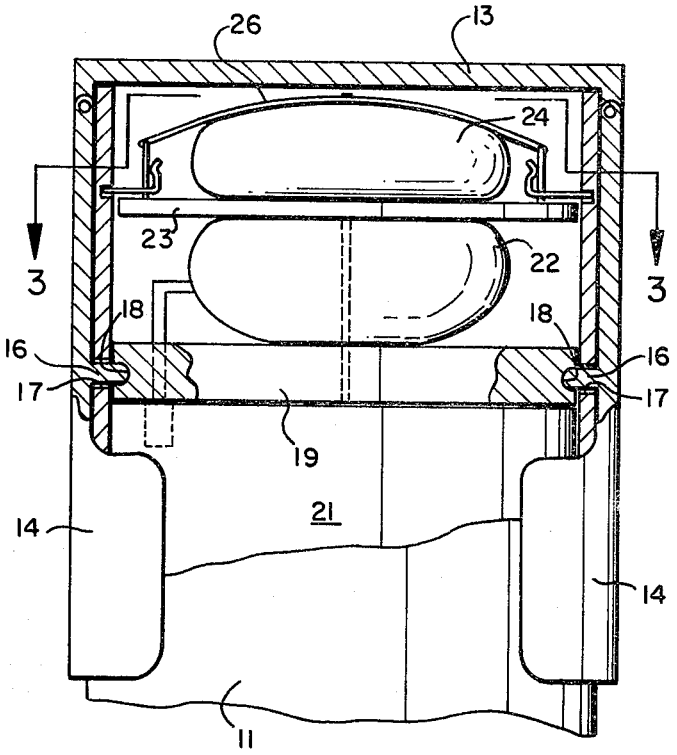
FIG. 2 represents a cross-sectional side view of the aft portion of the sonobuoy taken along the line 2—2 of FIG. 1.
Figure 3:
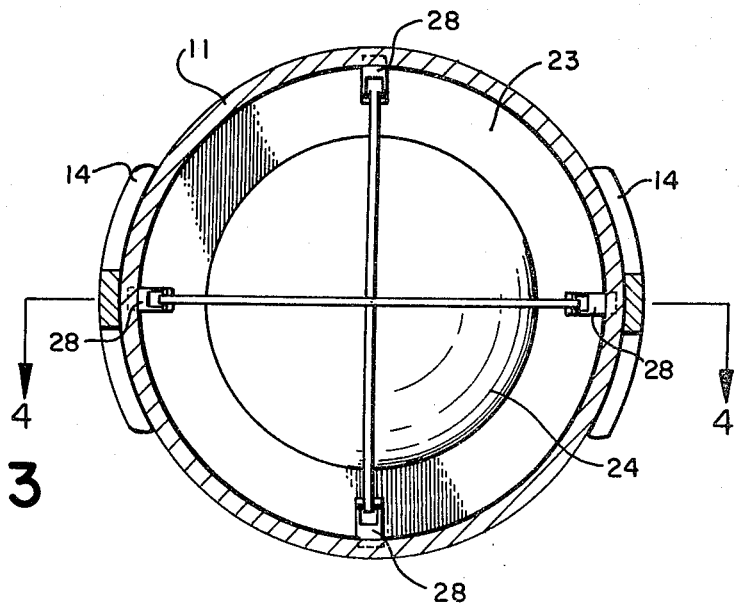
FIG. 3 represents a cross-sectional end view of the sonobuoy taken along the line 3—3 of FIG. 2.
Figures 4, 7A, 7B, 7C:
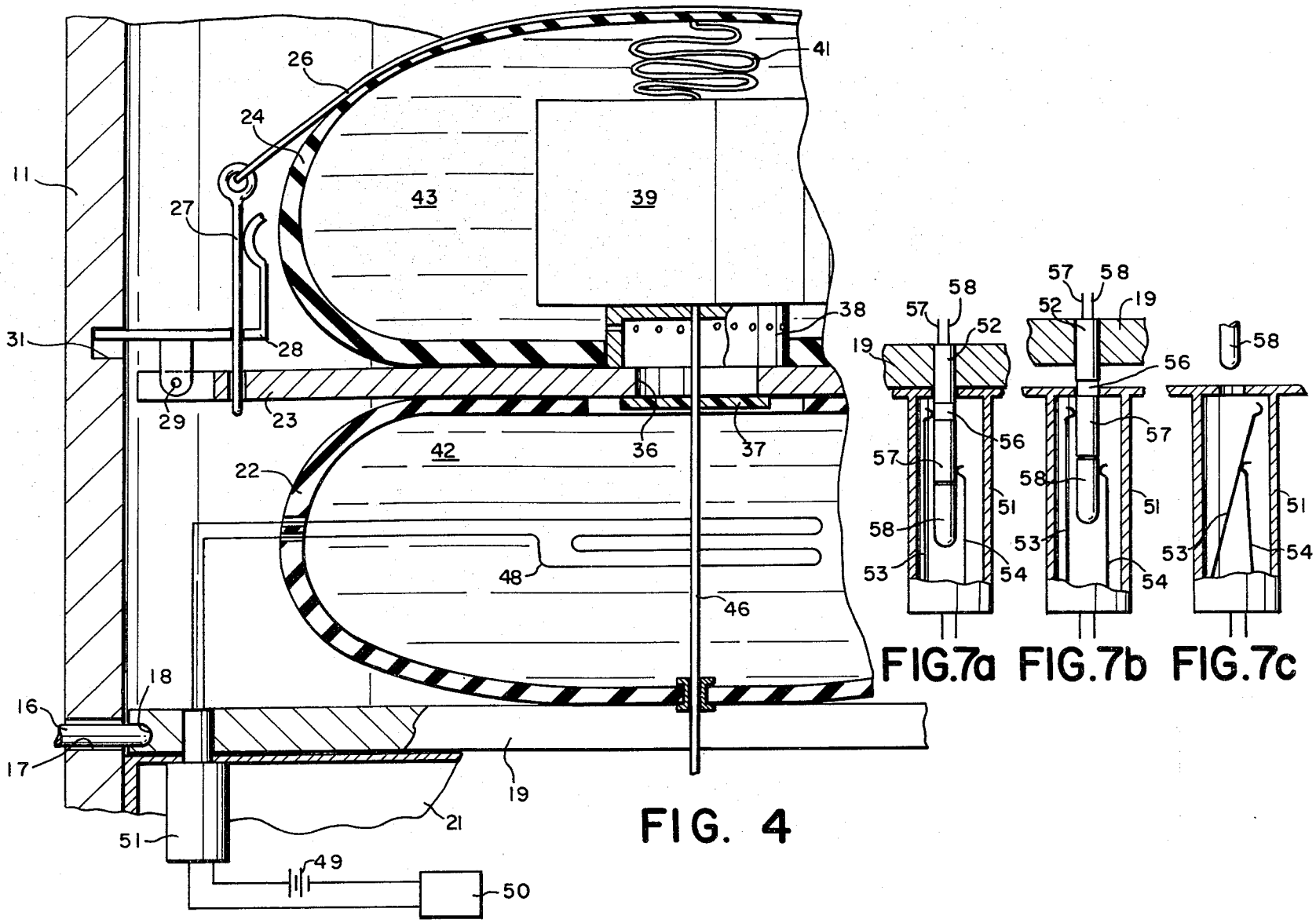
FIG. 4 is a cross-sectional side view of an aft portion of the sonobuoy taken along the line 4—4 of FIG. 3.
FIGS. 7*a*, 7*b* and 7*c* illustrate in cross-sectional views a disconnect switch within the sonobuoy of FIG. 1 at three discrete stages of deployment.
Figure 5A:
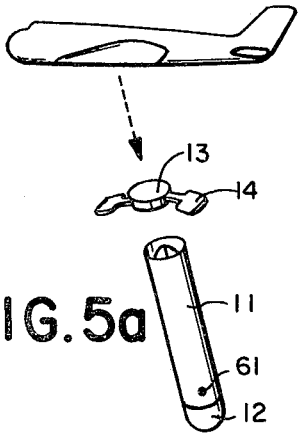
FIGS. 5*a*, 5*b* and 5*c* illustrate three stages of deployment from an aircraft of the sonobuoy of FIG. 1.
Figure 5B:
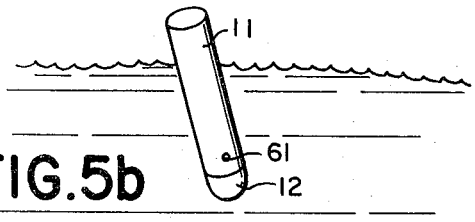
Figure 6A:
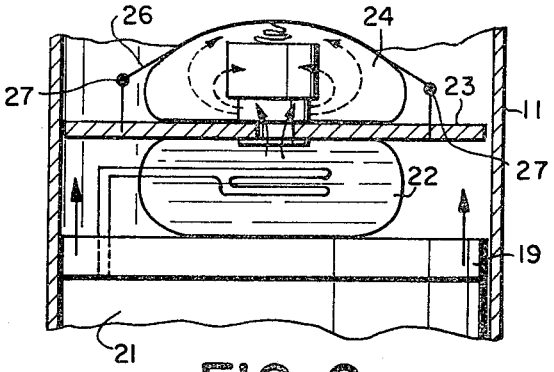
FIGS. 6*a*, 6*b*, and 6*c* illustrate three stages of operation of the flotation device within the sonobuoy of FIG. 1.
Figure 6B:
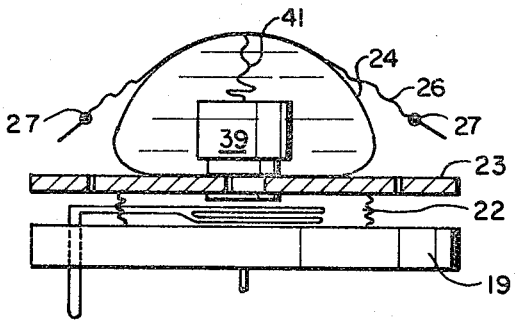
Figure 5C:
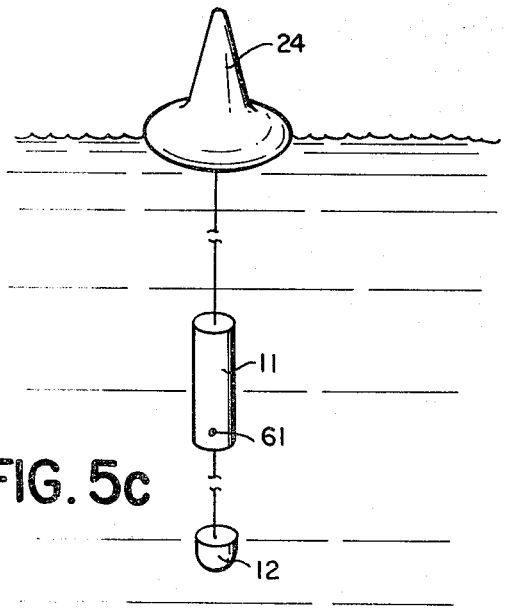
Figure 6C:
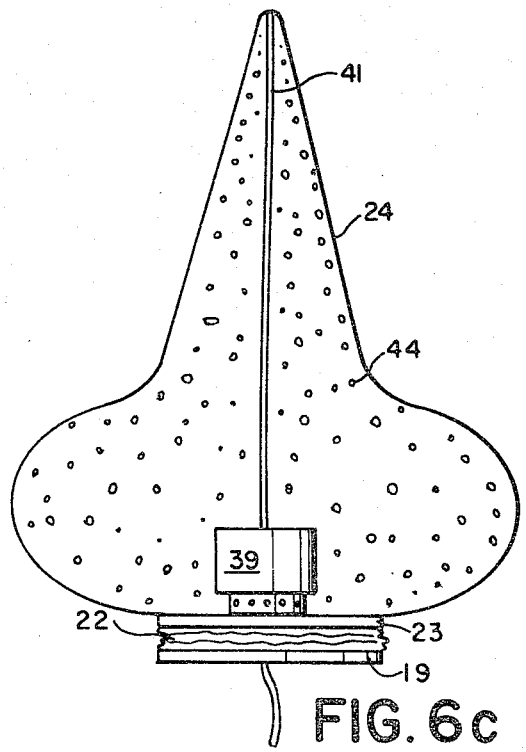

Referring now to the drawings wherein like characters designate like or corresponding parts throughout the several views, FIG. 1 shows a complete sonobuoy 10 according to the invention suitable for insertion in a standard aircraft store launcher. It includes a submersible cylindrical housing 11 containing a power supply, hydrophone suspension system and electronic components for signal processing. The forward or lower end is sealed by a hydrophone assembly 12 which is separable and deployable from housing 11 upon water impact by conventional means not shown. The upper or aft end of housing 11 is sealed by a removable end cover 13 to which a pair of opposed windflaps 14 are pivotally connected and which extend forwardly along opposite sides of housing 11. Referring to FIGS. 2 and 4, windflaps 14 are held against the housing 11 by pins 16 which extend inwardly through holes 17 in housing 11, and terminate in recesses 18 of a preload plate 19. Plate 19 is slidable within and along the length of housing 11 and is compressed against the forward components 21 within housing 11 by pins 16. The force imparted by the airstream upon launching pivots flaps 14 outwardly and withdraws pins 16 allowing plate 19 to move aftwardly against a compressible container 22. Container 22 is externally secured between the aft side of plate 19 and the forward side of a retaining plate 23, for internally communicating with elastic envelope 24 secured to the aft face of plate 23. Container 22 and envelope 24 are each filled with foaming chemicals 42 and 43 which react when mixed to produce an expanded, closed cell material of a low density and sufficient volume to support the container 11 and components depending therefrom at the water surface. A pair of orthogonal lanyards 26, stretched across the aft surface of envelope 24, terminate with four pins 27 removably inserted through respective retaining plate release latches 28 and corresponding holes in plate 23. Each latch 28 is pivotally mounted by a pin 29 to plate 23 with one end radially extending into a recess 31 in housing 11. The other end of latch 28 abuts pin 27 thereby preventing latch 28 from rotating out of recess 31 and releasing plate 23.

A central opening 36 in plate 23 provides a passage for the chemical in container 22 to flow to envelope 24 but for a rupturable diaphragm 37 sealing the opening 36. A jet mixer 38 mounted on the aft side of plate 23 includes a plurality of orifices about the periphery which communicate between the opening 36 and the interior of envelope 24 adjacent to the base portion. A sealed container 39 within envelope 24 mounted on the mixer 38 contains a radio transmitter whose output is connected to an antenna 41 secured at the outer end to the middle of envelope 24. A signal cable 46 electrically connected to the transmitter in container 39 extends through mixer 38, diaphragm 37, container 22 and plate 19 to the housing 11 where it electrically connects to the electronic components therein.

As shown in FIG. 4, the wall thickness of envelope 24 is preferably tapered from being relatively thick at its base adjacent to plate 23 to being thin in the vicinity of antenna 41. The taper is varied in a well-known manner so that when the foam expands the envelope 24 will form a large sphere-like base for flotation, and a vertical extensin for erecting antenna 41.

A resistance heater 48 within container 22 provides preheating of chemical 42 for accelerating the reaction with chemical 43 when they are mixed. Power for energizing heater 48 is derived through a disconnect jack 51 from a battery 49 in series with the electronic components 50. Referring to FIG. *7a*, the jack 51 includes a plug 52 fixed to plate 19 and armatures 53 and 54 fixed to components 21 and electrically contacting non-conductive segment 56 and conductive segment 57 respectively when plate 19 is secured by pins 16. There is no current drain from battery 49 due to the open circuit. Referring to FIG. *7b*, when plate 19 is released, plug 52 starts to withdraw and armatures 53 and 54 electrically contact conductive segments 57 and 58 respectively. Current now passes through heater 48 and electronics 50. Now referring to FIG. *7c*, when plate 19 fully compresses container 22, plug 52 withdraws further allowing armatures 53 and 54 to shunt heater 48 and energize only electronics 50. This switching arrangement is particularly suitable for use with a lithium battery supply. The power for heating chemical 42 also provides the initial high current drain required to condition the battery to output the design current.

The sonar transmitting and receiving components are packaged within housing 11 so that it remains positively buoyant in the water with the flotation device on top. An orifice 61 in housing 11, longitudinally positioned below the waterline when housing 11 is initially at rest on the surface, permits water intake to fill the voids at a rate that will maintain positive buoyancy until the envelope 24 expands and extracts pins 27. At this point, the housing 11 will sink and deploy the hydrophone suspension system. By controlling the rate of water intake through orifice 61, maximum design expansion of envelope 26 is assured at a low ambient hydrostatic pressure.

Insofar as pertinent to the flotation device of the present invention, operation of the various parts of the sonobuoy from launch to operation in the water is summarized as follows. As seen in FIG. *5a*, sonobuoy 10 is ejected in flight from an aircraft launch tube of convention design. The airstream forces windflaps 14 to spread and withdraw pins 16. This allows preload plate 19 to compress container 22 against retaining plate 23. The resulting increase in pressure of chemical 42 within container 22 ruptures diaphragm 37 to force the liquid chemical through opening 36 and the orifices of mixer 37 into envelope 24. The peripheral arrangement of the orifices in mixer 38 insures thorough mixing in all radial directions. As shown by the arrows in FIG. *6a*, chemical 42 is forced through the orifices, circulates in chemical 43 along the bottom and up the sides of envelope 24, and finally returns to the center. This circulation is necessary for rapid reaction of the total liquid volume, and stops when all of chemical 42 is in envelope 24 with preload plate 19 hard against retaining plate 23. Mixing occurs in about 10 seconds, mostly during the air deployment shown in FIG. *5a*.

Simultaneous with the aftward movement of preload plate 19, resistance heater 48 is energized through jack 51 and battery 49 causing chemical 42 to heat and accelerate the chemical reaction time for foaming in container 24.

After impact with the water, as shown in FIG. *5b*, housing 11 remains temporarily buoyant with the flotation end up. During this phase, the mixture of the foaming chemicals 42 and 43 is completed and foam expansion will start. The chemicals react within 3 to 5 minutes, and during this interval the envelope 24 must be at a low external pressure at the surface of the water for efficient expansion.

Referring to FIG. *6b*, as envelope 24 expands, it puts lanyard 26 under tension pulling pins 27 from latches 28 to release retaining plate 23 and separate housing 11 therefrom. As housing 11 fills with water through orifice 61, it sinks and envelope 24 continues to expand.

The tapered walls of envelope 24 dictate elongation in the vicinity of antenna 41 than around plate 23 so that the final shape of the envelope 24, as shown in FIG. *6c*, is relatively flat on the bottom for minimizing the depth of water submergence and water drag, and conical on top for erecting antenna 41. For the drifting sonobuoy suspension, system as finally deployed in FIG. *5c*, this configuration reduces the relative flow at the hydrophone 12 and thereby decreases flow noise. Typically, the volumetric expansion of the foam 44 is about 30 to 1. The initial volume of the chemicals is determined to insure that 30 times this volume will provide the necessary buoyancy for the suspension system with the water line at about the maximum circumference of the fully inflated envelope 24.

Some of the many features and advantages of the present invention should now be apparent. For example, a novel and reliable flotation device for an air launched sonobuoy is provided which uses expanded, closed cell rigid foam for buoyancy. It does not depend on water seals or gas inflation for buoyancy. Chemical foaming liquids are automatically mixed upon air deployment, and stirred by closed loop circulation. A tapered wall elastic envelope determines the desired final float shape, flotation and antenna erection. After water impact, the buoy housing will stay afloat for optimizing foam expansion. The flotation device can be stored in a relatively small spare and expanded to a volume sufficient to support a sonar transmitting and receiving system. The device is of very simple design, and lends itself to manufacture using conventional components and techniques.

It is understood that the above-described embodiment is only illustrative, and that various modification and steps may be made by those skilled in the art without departing from the spirit and scope of the invention as claimed.

What is claimed is:

1. A buoy launchable in air from an elevated platform comprising, in combination:

suspension means deployable below the surface of a body of water;

flotation means deployable at the surface of the water for supporting said suspension means at a selected depth, said flotation means including an expandable envelope containing a first foaming reactant, a flexible envelope communicating with said expandable envelope containing a second foaming reactant, first plate means releasably secured to said suspension means for compressing said flexible envelope and causing said reactants to mix and foam in said expandable envelope; and windflap means, responsive to the dynamic air pressure produced upon launching of said buoy, operatively connected to said suspension means and said flotation means for releasing said first plate means and initiating foaming of said flotation means.

2. A buoy according to claim 1 wherein said flotation means includes:

second plate means between said envelopes;

a latch pivotally connected to said second plate means and extending into said suspension means; and a lanyard operatively connected between said latch and said expandable envelope for releasing said second plate means when said reactants begin to foam.

3. A buoy according to claim 2 wherein:

said second plate means includes a circular array of orifices communicating between said envelopes for directing said second reactant in a circulatory flow within said first reactant.

4. A buoy according to claim 3 wherein:

said second plate means further includes a ruptural member occluding communication through said orifices until a predetermined pressure level applied by said second reactant.

5. A buoy according to claim 4 further comprising:

heater means positioned within said flexible envelope initiated by release of said first plate means for preheating said second reactant.

6. A flotation device for extending a flexible antenna therein, comprising, in combination:

an inelastic flexible envelope containing a first foaming reactant;

an elastic envelope formed to connect the ends of the antenna at opposite surfaces and communicating with said flexible envelope, said elastic envelope containing a second foaming reactant forming an expanded rigid foam therein when mixed with said first reactant; and a rupturable diaphragm secured between said envelopes for preventing mixing of said reactants until a predetermined pressure of said first reactant.

7. A flotation device according to claim 6 wherein:

said elastic envelope is of variable thickness for expanding in controlled directions forming a round base with a protuberance for erecting the antenna therewithin.

8. A flotation device according to claim 7 further comprising:

a circular array of orifices communicating between said envelopes for directing said first reactant in circulatory flow within said second reactant.

9. A sonobuoy launchable in air from an aircraft comprising, in combination:

a housing;

a hydrophone suspension system within said housing deployable below the surface of a body of water;

a flotation device within said housing deployable at the surface of the water for supporting said suspension system at a selected depth, said flotation device including an expandable envelope containing a first foaming reactant, a flexible envelope communicating with said expandable envelope containing a second foaming reactant, a first plate releasably secured to said housing for compressing said flexible envelope and causing said reactants to mix and foam in said expandable envelope; and windflap means, responsive to the dynamic air pressure produced upon launching of said sonobuoy, operatively connected to said housing and said flotation device for releasing said first plate and initiating foaming of said flotation device.

10. A sonobuoy according to claim 9 wherein said flotation device includes:

a second plate between said envelopes;

a latch pivotally connected to said second plate and extending into said housing; and a lanyard operatively connected between said latch and said expandable envelope for releasing said second plate when said reactants begin to foam.

11. A buoy according to claim 10 wherein:

said second plate includes a circular array of orifices communicating between said envelopes for directing said second reactant in a circulatory flow within said first reactant.

12. A buoy according to claim 11 wherein:

said second plate further includes a ruptural member occluding communication through said orifices until a predetermined pressure level applied by said second reactant.

13. A buoy according to claim 12 further comprising:

heater means positioned within said flexible envelope initiated by release of said first plate for preheating said first reactant.

* * * * *